US011457753B2

(12) United States Patent
Mighali

(10) Patent No.: US 11,457,753 B2
(45) Date of Patent: Oct. 4, 2022

(54) CHILDCARE ARTICLE OF THE BABY BEDDING TYPE

(71) Applicant: Sophia Mighali, Geneva (CH)

(72) Inventor: Sophia Mighali, Geneva (CH)

( * ) Notice: Subject to any disclaimer, the term of this patent is extended or adjusted under 35 U.S.C. 154(b) by 103 days.

(21) Appl. No.: 16/961,848

(22) PCT Filed: Feb. 25, 2019

(86) PCT No.: PCT/IB2019/051490
§ 371 (c)(1),
(2) Date: Jul. 13, 2020

(87) PCT Pub. No.: WO2020/008273
PCT Pub. Date: Jan. 9, 2020

(65) Prior Publication Data

US 2020/0345159 A1 Nov. 5, 2020

(30) Foreign Application Priority Data

Jul. 6, 2018 (FR) ..... 1856259
Jan. 28, 2019 (EP) ..... 19153868

(51) Int. Cl.

| | |
|---|---|
| ***A41B 13/06*** | (2006.01) |
| ***A47G 9/08*** | (2006.01) |
| ***A47D 13/08*** | (2006.01) |
| ***A47D 15/00*** | (2006.01) |
| *A47G 9/10* | (2006.01) |

(52) U.S. Cl.
CPC ..... *A47G 9/083* (2013.01); *A41B 13/06* (2013.01); *A47D 13/08* (2013.01); *A47D 15/008* (2013.01); *A47G 9/1036* (2013.01)

(58) Field of Classification Search
CPC ..... A47G 9/083; A47G 9/1036; A41B 13/06; A47D 13/08; A47D 15/008
See application file for complete search history.

(56) References Cited

U.S. PATENT DOCUMENTS

| | | | | |
|---|---|---|---|---|
| 5,129,406 | A * | 7/1992 | Magnusen | A41B 13/06 128/845 |
| 5,545,199 | A * | 8/1996 | Hudson | A47G 9/1036 5/421 |
| 9,820,907 | B1 * | 11/2017 | Bush | A47D 13/08 |
| 2013/0111661 | A1 | 5/2013 | Furuland | |
| 2016/0051430 | A1 * | 2/2016 | Bader | A47C 31/123 128/845 |

FOREIGN PATENT DOCUMENTS

| | | |
|---|---|---|
| WO | 2014125472 | 8/2014 |
| WO | 2018014077 | 1/2018 |

* cited by examiner

*Primary Examiner* — Fredrick C Conley
(74) *Attorney, Agent, or Firm* — Wissing Miller LLP

(57) ABSTRACT

The invention relates to a bedding article for a baby, comprising a soft base (10) provided with an edge roll (20) secured to the base (10) and extending over at least part of the periphery thereof, said edge roll (20) being provided with a free end (25) that can be folded over onto the stomach of the baby. The edge roll (20) contains a tubular insert (30) having a complementary shape, which is designed to be heated and to progressively emit the heat received. The article also comprises a cloth for swaddling the baby and a cover (50). The cover is designed to partially cover at least the base and particularly the free end (25).

20 Claims, 16 Drawing Sheets

CHILDCARE ARTICLE OF THE BABY BEDDING TYPE

This application is a 371 of PCT/IB2019/051490 filed on Feb. 25, 2019, published on Jan. 9, 2020 under publication number WO 2020/008273, which claims priority benefits from French Patent Application No. 18/56259, filed on Jul. 6, 2018, and from European Patent Application No. 19153868.5, filed Jan. 28, 2019 the disclosures of which are incorporated herein by reference.

The present invention relates to a childcare article of the bedding or reclining pillow type for baby and/or infant.

In the field of childcare, and in particular items for babies and infants, a number of items exist for helping babies sleep, better digest and/or find restorative sleep.

For example, many so-called nursing pillows or inserts are known that generally comprise a peripheral edge roll intended to keep the baby in place, these pillows generally not including means for keeping the baby in place, aside from the peripheral edge roll. The pillow also exists in the form of arms at each end of a hand and intended to simulate being enveloped in arms. Simple pillows also exist in the form of a tubular insert bent in a U intended to contain the child. These pillows generally do not contain means for holding the baby, which can generate fall risks, in particular if the baby is very restless. They are also often too large and do not fit in strollers and/or collapse under the weight of the baby, ultimately resulting in a lack of support for the baby.

A shaped pillow exists that is made up of a thick block of a resilient foam, of the polyurethane type, defining a hollow area for the body and a hollow area for the legs, the two hollow areas being separated by a central edge roll to allow the legs to be brought into the fetal position. The pillow further includes a central strip for holding the body, intended to prevent the baby from falling off the pillow, but which does not prevent the baby from moving. The shape also allows a certain upward incline of the head to facilitate digestion and sleeping. The thickness of the foam pillow is provided to prevent collapse under the weight of the baby and therefore to guarantee a constant shape. However, the foam thickness leads to a large volume, and depending on the quality of the foam, a potentially significant weight. Such a pillow is also extremely expensive relative to the other types of pillows, and does not address all of the sleep and digestion issues of a baby. Such a pillow is also not suitable for strollers due to its volume. Furthermore, the significant thickness of the pillow may cause tipping problems in case of major gesticulations by the baby.

Swaddling covers also exist that completely contain the baby and in particular prevent the arms from leaving, but also prevent the legs from moving and are therefore too restrictive, and additionally do not address the issue of correct positioning of the newborn or of difficult digestion.

Patent application WO2014125472A1 relates to bedding for a premature baby comprising a mattress on which the baby rests and two elongated pillows, a central part of which is attached to the mattress and the ends of which are free; such that the two attached zones of the pillows give the premature baby a sense of security through the edges that they form, while the free ends of the pillows can be arranged freely around the baby. The mattress can be associated with a sheet that simply surrounds the mattress (FIG. 9). Such bedding is additionally adapted to an incubator or a bed by providing greater comfort and security for the holding of the baby. However, it is not designed to transmit heat.

Application WO2018014077 relates to a medical pouch for a newborn comprising a base surface on which the newborn rests, a curved portion including a bottom for holding the legs and two opposite free ends for holding the head. Additionally, lateral straps are provided to immobilize the newborn on the base. Such an assembly is intended to keep the newborn in a suitable position for proper development while reducing the stresses in particular on the spinal column and head region of the newborn.

Utility model CN202143691U relates to bedding in particular for use in an incubator that comprises an ecliptic mattress extending on one side by a headrest pillow and a protective rim comprising two ends that can be connected by laces.

The prior art does not propose a satisfactory solution making it possible to keep the baby both warm and in a comfortable position in particular promoting sleep.

The aim of the present invention is to resolve these drawbacks.

One aim of the present invention is to provide a childcare article for a baby and/or infant that is compact, inexpensive, warming and effectively helps with the sleep and/or digestion of the baby.

One aim is in particular to provide a childcare article that is easily transportable and/or adaptable to different formats: bed, stroller, etc.

Another aim is for the baby to be kept warm effectively in place in the correct sleeping and digestion position.

Another aim is for the baby to be kept in place without risk of tipping.

This or these aim(s) are achieved according to the claims that follow.

The invention is defined according to claim 1, and more specifically by the dependent claims.

According to one aspect, the bedding article for a baby according to the invention includes a soft base that is preferably inextensible, substantially to the dimensions of the baby to be accommodated, this base being provided with an edge roll secured to said base and extending over at least part of its periphery, the edge roll being provided with a free end able to be folded over on the stomach of the baby.

According to one embodiment, the free end of the edge roll is provided with a ballast. Furthermore, the edge roll is able to serve as support for the head and/or the legs of the baby.

In this way, the baby is held peripherally by the edge roll, which makes it possible both to raise his head and legs, and the ballasted free end of the edge roll applies a weight on his stomach serving the dual function of facilitating his digestion and aiding more lasting deep sleep.

According to one embodiment, the edge roll contains a tubular insert.

The tubular insert is preferably a warming tubular insert, emitting, by inertia, the heat accumulated during a heating step of the tubular insert. The tubular insert is designed to accumulate heat through an external heating means.

The edge roll can have a circular cross-section.

The edge roll can be detachably secured to the bottom. Means for removably connecting the edge roll to the soft bottom can for example be: a zipper device, buttons, snaps, a device with textile hooks and loops of the Velcro type. These means can be distributed over at least part of the length of the edge roll.

The edge roll contains a tubular insert complementary in shape to the edge roll configured to be heated, in particular to receive heat and gradually emit it. The heat makes it possible to give the baby a safe feeling promoting sleep and digestion.

Preferably, the heating insert extends in the second free end. Thus, at least part of the heat is transmitted on the part of the baby on which the free end bears. Preferably, the tubular insert extends over the entire length of the edge roll.

Preferably, the tubular insert is removable.

The tubular insert can be contained in an enclosure of the edge roll. The tubular insert can be detachable from the enclosure of the edge roll. The enclosure can be provided over its entire length with a closable opening. This opening makes it possible to place the tubular insert. The enclosure may comprise a quick closure means such as a zipper, buttoning, snaps or any equivalent means. The enclosure may be made from textile materials such as cotton, linen, synthetics or a combination. Thus, the enclosure ensures hygienic contact with the baby and thermal protection.

According to one embodiment, the tubular insert is subdivided into insert portions. This construction makes it possible to guarantee that the tubular insert remains in shape and in place and, for example, that it does not collapse under the weight of the baby, the article therefore always retaining the desired shape.

It should be noted that the tubular insert can be made in several parts that are separate or connected to one another. The edge roll can also be made from several separate portions, each edge roll portion being able to receive a portion of the tubular insert.

The tubular insert extends in the free end, preferably over the entire length of the edge roll.

The tubular insert is preferably configured to accumulate heat through radiation, conduction or convection. Preferably, the tubular insert is preferably configured to accumulate heat through microwave radiation or by conduction. Thus, the tubular insert can be heated easily in a microwave oven or on a radiator.

Preferably, the tubular insert is a dry heating pad.

The tubular insert may be microwavable.

The heating insert contains heating elements configured to store heat and gradually emit this heat; these elements being organic, preferably chosen from grains of linen, grains of rice, barley, wheat, lentils, grape seeds, peas, lupine seeds, chickpeas, fruit cores (for example, cherry pits), dried plants (for example, lavender flowers), other dried vegetables and other cereal grains (for example spelt, rapeseed, etc.) or inorganic, preferably chosen from beads or small pieces of clay, silicone, sugarcane, plastic, ceramic, glass, sand and combinations thereof, or any other organic or inorganic material capable of accumulating and emitting heat.

The tubular insert may contain a cloth cover to keep the heating elements inside in the form of one or several masses of elements.

However, the tubular insert may also be a hot water bottle. The tubular insert may also contain a liquid-tight soft pouch provided with at least one inlet closed removably by a stopper and/or a valve.

According to one embodiment, the article includes a cloth for swaddling the baby, this cloth making it possible to swaddle the baby and keep him in the correct needle position to encourage sleeping; it also makes it possible to guarantee that the baby will not tip. The swaddling cloth can be in the central position or be independent from the soft base.

According to one aspect, the swaddling cloth has an elongated shape, the width of which becomes smaller in the direction of the ends in a transverse direction; said cloth comprising two distant arm passage holes that are substantially aligned in the transverse direction. The cloth also preferably comprises a passage distant from the arm passage holes in a longitudinal direction and that is configured to form a loop for one of the ends of said cloth.

Preferably, the article includes a cover arranged at least at one end of the base. The cover is configured to cover the free ends of the edge roll and at least partially the soft base. The cover comprises at least one portion configured to cover the free ends of the edge roll and at least part of the soft base.

Thus, the cover can be folded over the body of the baby to provide additional heat. The efficiency of the heat produced by the heating insert can thus be maintained for longer.

The heating elements of the tubular insert preferably extend in the free ends [and] serve as ballast in the edge roll.

The cover can form a bag connected to the base. It may comprise removable lateral closures, such as zippers. It is possible to provide that the dimensions of the cover are provided so as not to cover the face for safety reasons.

According to another embodiment, the cover includes two holes able to cooperate with soft ties coming from the base; this arrangement makes it possible, by knotting the ties after folding the cover over, to guarantee that the cover stays in place on the baby and keeps him in place during all phases of sleep, in particular allowing deep and restorative sleep.

According to one embodiment, the cover has a changing volume allowing it to be adapted to the morphology and/or age of the baby so as to reduce heat losses. To that end, the cover comprises a foldable lower edge and first fastening means arranged on or near said edge cooperating with a series of complementary fastening means arranged on a bottom of said cover on the side opposite the soft base and at different distances from said edge so as to allow an adjustment of the volume of the cover. For example, the first and second fastening means are quick fastening means such as snaps, or a system of textile hooks and loops of the Velcro type or sets of buttons and slits or loops or any other equivalent quick fastening means.

According to another possible aspect, the edge roll comprises a second free end that is dimensioned to be able to be folded over on the base to serve as a booster for the legs of the baby.

The cover is also configured to cover said second free end of the edge roll.

The second free end is preferably occupied by the heating insert. Thus, once placed, the two free ends are capable of emitting heat homogeneously around the baby.

The second free end can be fastened on the bottom using removable connection means.

Preferably, the second free end comprises at least a first removable connection means and the soft base comprises a series of second removable connection means that are complementary to the first means; the second means being distributed on one side of the bottom of the soft base and at a distance from one another so as to make it possible to adjust the height of the fastener of the free end on the base as a function of the size of the baby. For example, the first connection means and the second fastening means are quick fastening means such as snaps, or Velcro or sets of buttons and slits or loops or any other equivalent quick fastening means.

The device can be inserted in a carrying bag or small suitcase such as a bag made from fabric from natural fibers, for example provided with carrying handles and a removable clasp.

Ultimately, the article according to the invention combines the advantages of pillows with edge roles, swaddling cloths, while providing other functionalities making it possible to address the drawbacks of the prior art and to facilitate deep and lasting sleep of the baby.

Other features and advantages of the present invention will be shown using the following description of at least one non-limiting embodiment, in reference to the appended schematic drawing, in which:

FIG. 15 is a schematic view of the position of the baby on the swaddling cloth for swaddling with arms in;

In the description, "baby" will refer to any small child, and in particular newborn, infant able to use the bedding article 1 according to the invention.

Figure 1:
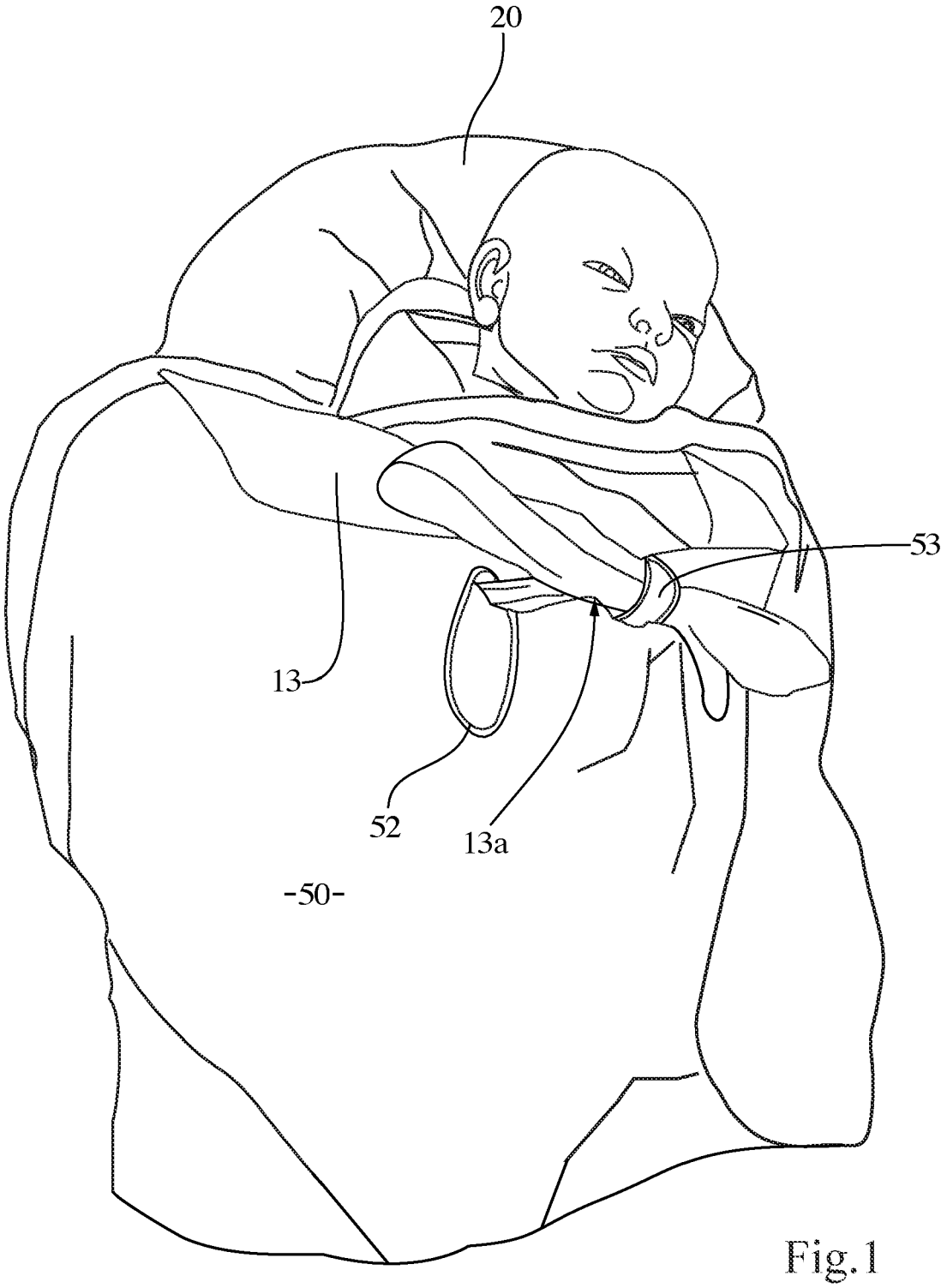
FIG. 1 is a schematic perspective view of one exemplary embodiment of the bedding article according to the invention with the baby placed therein.
Figure 2:
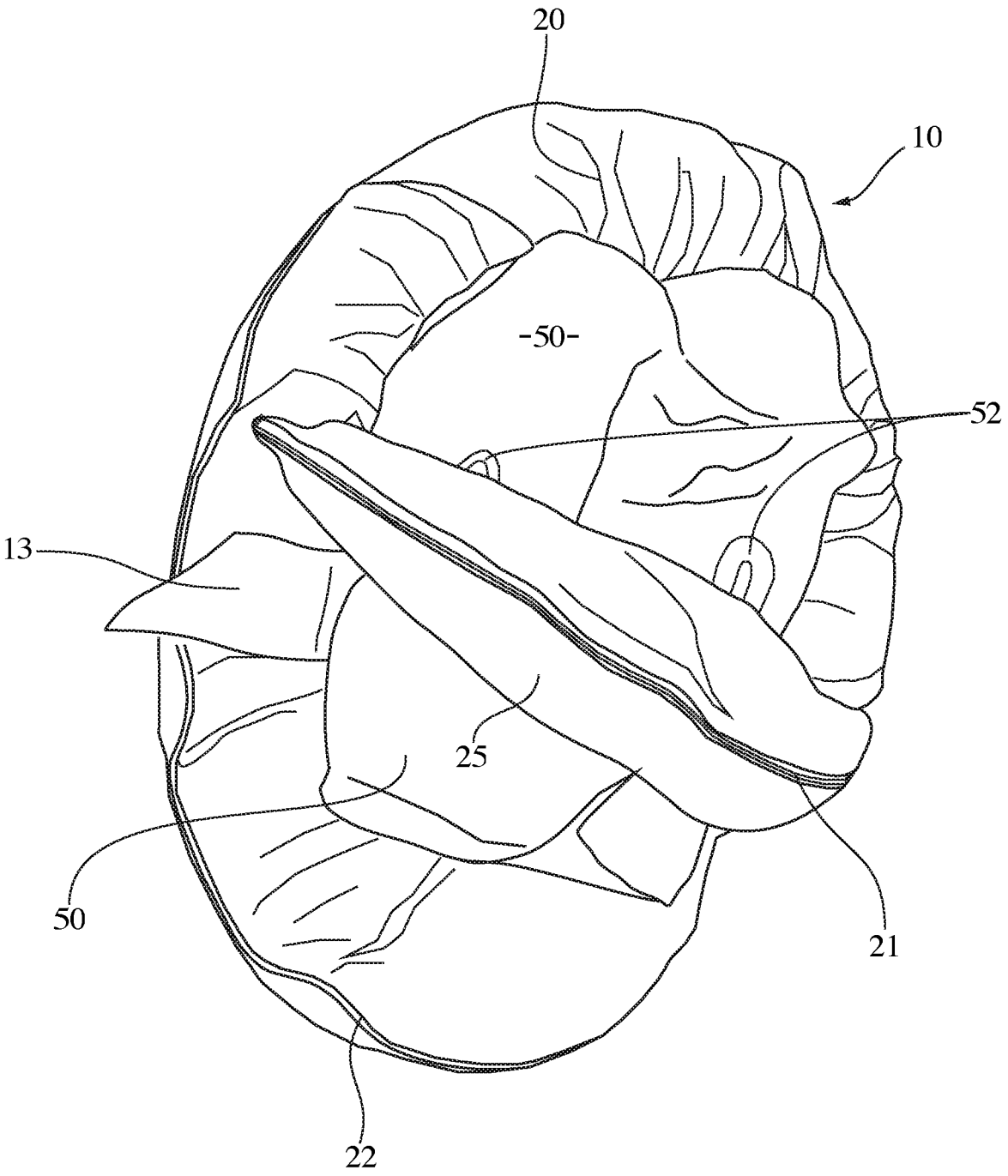
FIG. 2 is a view similar to FIG. 1 of the bedding article folded and without the baby.

As shown by FIGS. 1 and 2, the bedding article assumes the form of a type of soft pillow including a base 10 with a soft bottom 11 serving as coordinate system and on which all of the elements of the article 1 are fastened, and in particular a peripheral edge roll 20, a swaddling cloth 40, a cover 50 and fastening ties 13 able to cooperate with the cover 50, as will be seen later.

Figure 3:
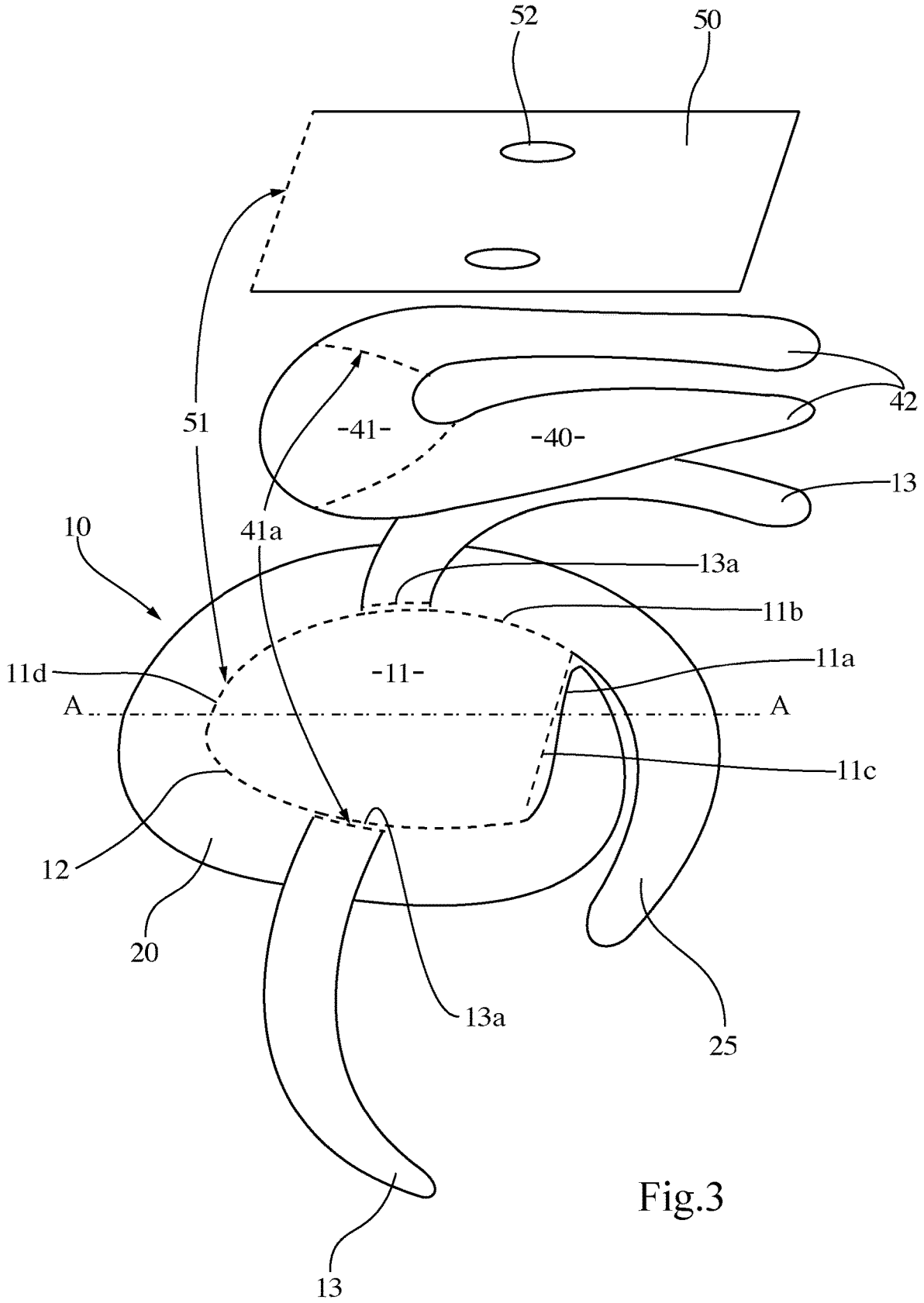
FIG. 3 is an exploded schematic perspective view of the article of FIGS. 1 and 2 according to the invention.
Figure 4:
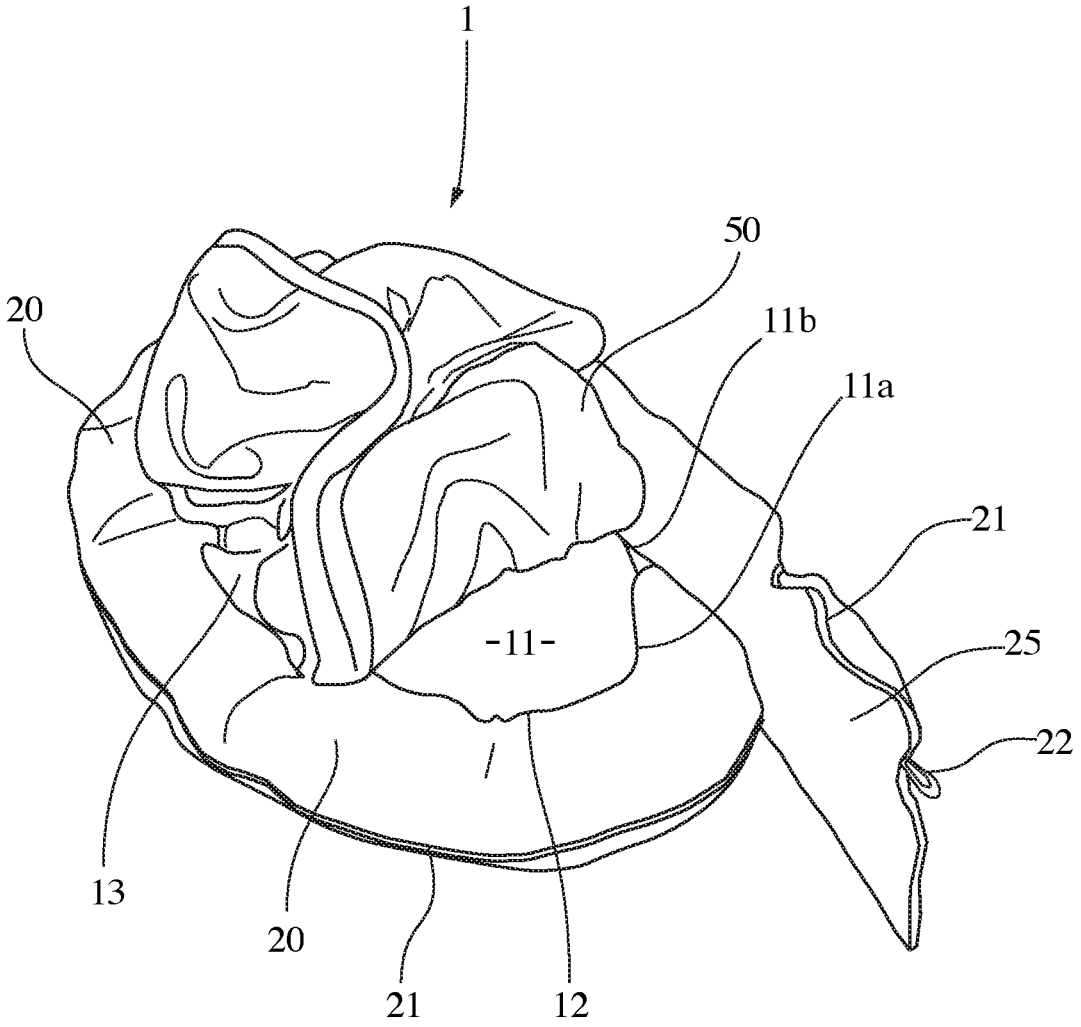
FIG. 4 is a perspective view more particularly showing the base.
Figure 5:
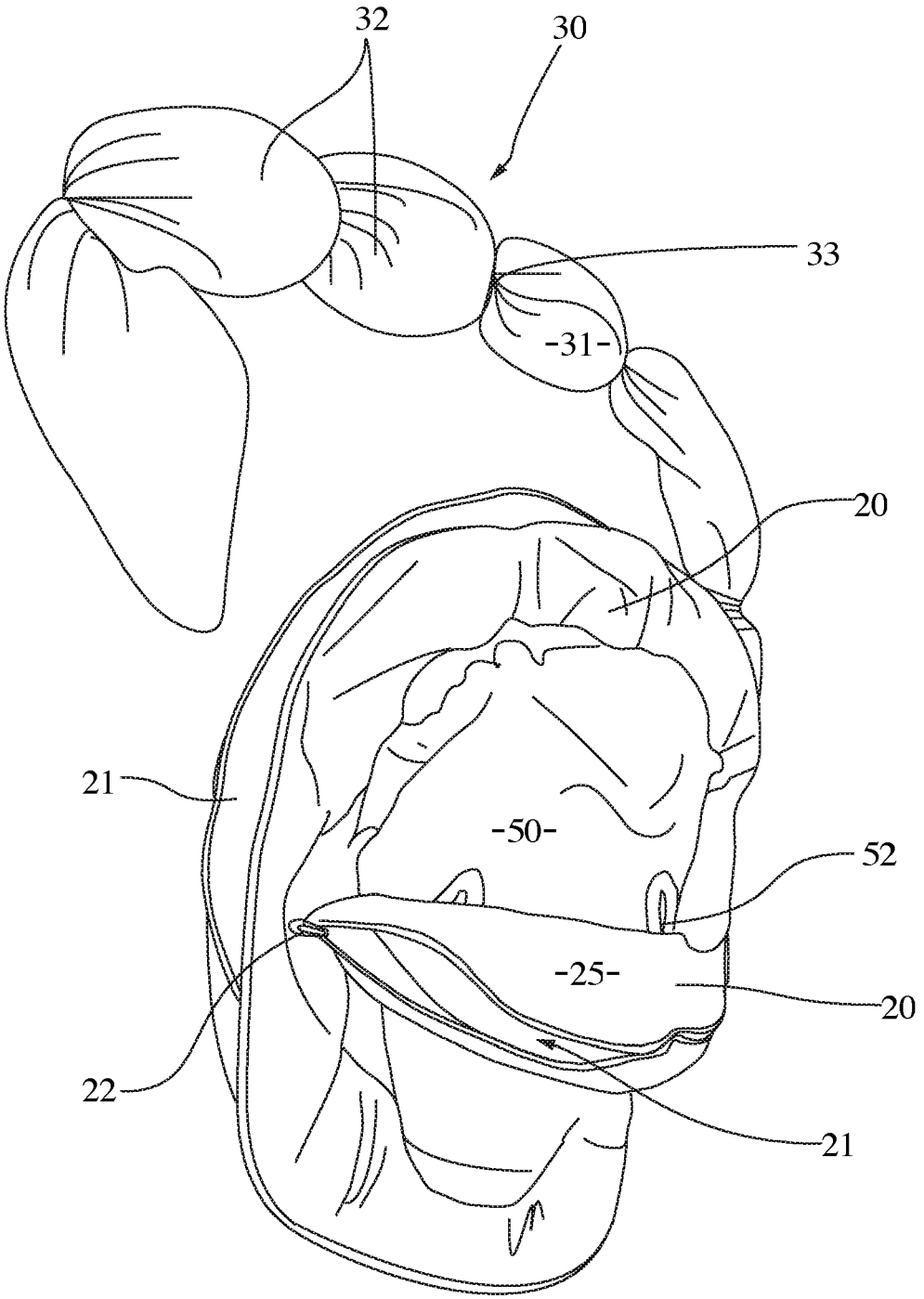
FIG. 5 is a side perspective view showing the tubular insert of the edge roll.
Figure 6:
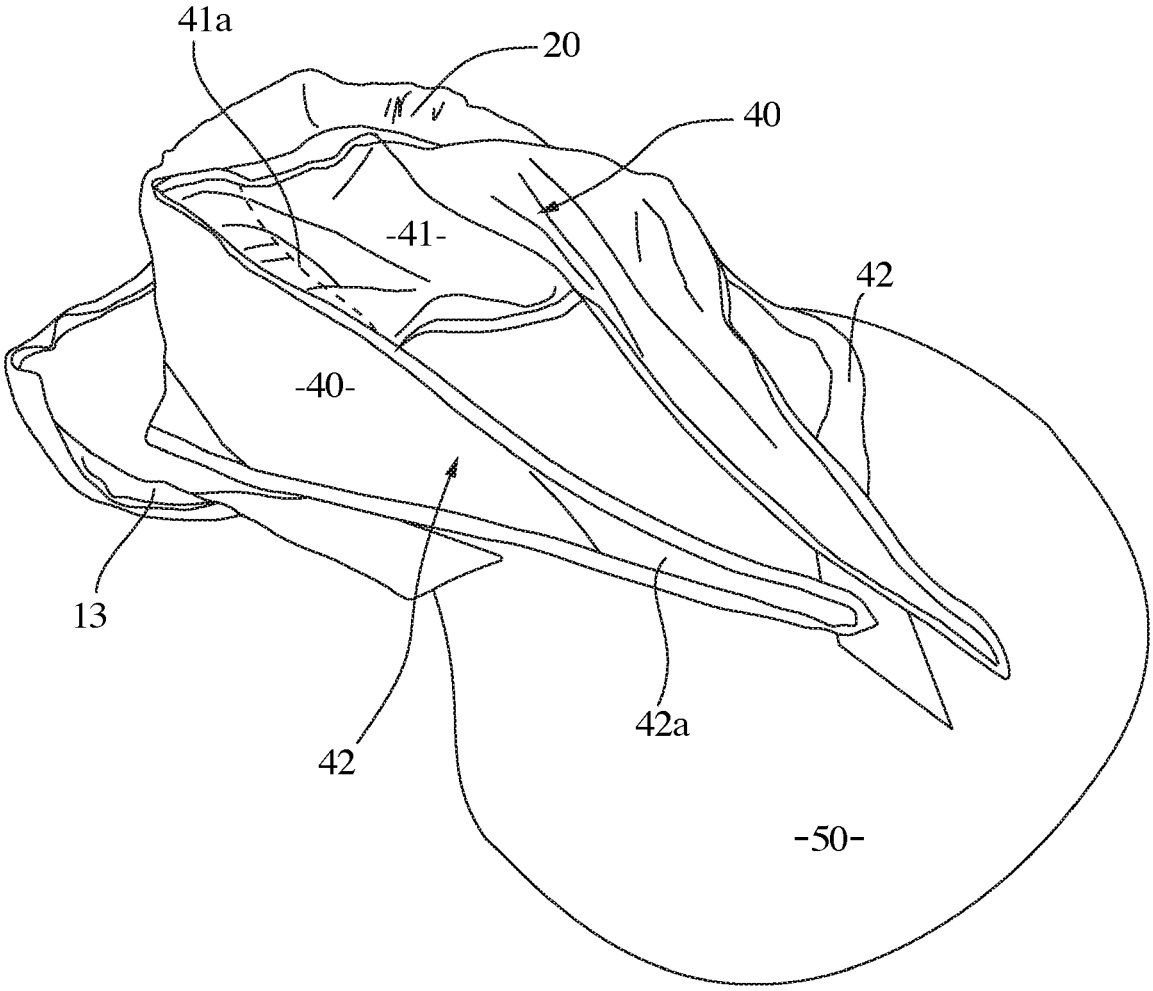
FIG. 6 is a perspective view showing the article unfolded.

As shown more particularly in FIG. 3, the bottom 11 is substantially oval or rectangular with rounded ends, the dimensions corresponding to those of the baby, child to be accommodated; in the case at hand, dimensions may be provided of 32 cm×22 cm for a newborn of average size. In the example, the bottom 11 is very flat and is made up of a textile such as cotton, organic cotton, alpaca wool, merino wool, sheepskin, hemp and linen, etc. A wool bottom has the advantage of being warm and also breathable. A hemp or linen bottom will be cooler, which may be interesting in the summer or in hot temperatures. It is in particular made from a woven textile, so as to be inextensible, serve as a reference and guarantee the final shape of the assembly. Depending on the case, a more extensible textile such as jersey could be provided. This bottom may, depending on the anticipated case and application, be made from a thicker material, and for example include a layer of foam.

An edge roll 20 is fastened on this bottom 11 by a seam 12, over practically the entire periphery. Indeed, the edge roll is fastened along the bottom 11 from a lower lateral end 11*a* to a part 11*b*, located approximately in the median zone of the base and arranged on the same side as the lateral end relative to an axis of symmetry AA'. It will be noted that the lower part 11*c* of the bottom can be substantially straight, while the upper part 11*d* is more rounded. Of course, the bottom 11 can have different shapes depending on the embodiments. The edge roll 20 also extends past the fastening zone of the median part 11*b* by a free end 25 having a length substantially corresponding to the width of the base so as to be able to be folded over the entire width thereof.

The edge roll 20 assumes the form of a long cylinder made from padded textile with a substantially circular cross-section. The edge roll 20 can be provided over its entire length with a longitudinal opening 21 for example closed by a zipper 22. It is possible to consider other closure modes for the longitudinal opening 21 and for example a closure by buttons, snaps, self-adhesive system of the type known under the commercial name Velcro, etc.

The enclosure of the edge roll 20 is made from a textile material such as cotton, organic cotton, hemp, linen, etc. Inside the enclosure of the edge roll 20, an insert 30 is housed that also has an elongated shape, the volume of which corresponds to the inner volume of the enclosure of the edge roll 20. This insert 30 is therefore also substantially in the shape of a long cylinder and is subdivided into insert portions 32 by seams or ties 33. The tubular insert 30 includes an outer enclosure 31 made from extensible fabric, for example of the jersey type. It is thus more comfortable and better adapts to the shape of the baby. Housed inside this textile enclosure 31 of the tubular insert 30 are grains or other similar heating elements able to store heat and gradually emit it, such as organic elements such as linen seeds, millet seeds, rapeseeds, spelt, grains of rice, barley, wheat, lentils, grape seeds, cherry pits, sugarcane, or inorganic elements preferably chosen from balls or pieces of clay, silicone, plastic, ceramic, glass, sand or the like. The tubular insert 30 can therefore be removed easily from the enclosure of the edge roll 20, and be heated by for example placing it in a microwave oven. According to one exemplary embodiment, the tubular insert is filled using linen seeds, brought to a temperature of 42° by heating for about 1 minute and 30 seconds in a microwave. It can next emit this heat gradually to the baby, the baby's own warmth also maintaining heat. The seeds, in particular those of dry legumes such as rice, lentils, seeds such as grape seeds, have a certain density, as a result of which the tubular insert thus formed is relatively dense and heavy, it stays in place and it does not collapse under the weight of the baby. Thus, the heating elements can serve as ballast in the edge roll.

As previously explained, the tubular insert 20 is connected (in particular by seam 12) to the bottom 11 of the base 10 over practically the entire periphery of the pillow. However, one free end 25 edge roll of the edge roll 20 remains not fastened to the base 10 and therefore extends freely relative to the latter. As will be seen later, this free end can then be folded over part of the body of the baby, and in particular the stomach of the latter, so as to exert a certain weight on this part and improve the digestion of the baby. This free end 25 of the edge roll and therefore the corresponding end of the tubular insert 30 may optionally be ballasted to further improve the ballasting effect on the stomach of the baby.

According to one embodiment, the weight of the tubular insert 30 is for example about 1.9 kg with rice as filler, and the weight of its ballast end is about 400 grams.

In the illustrated example, the edge roll 20 is the tubular insert and therefore the tubular insert 30 has an approximately constant transverse dimension of 8 cm. The thickness (transverse dimension) of the tubular insert is provided so as to allow a slight elevation of the baby's head and legs, this elevation being favorable to sleep and better digestion. This thickness also constitutes a lateral barrier for the baby's body, so as to prevent any risk of the baby falling. The high density of the filler grains (in particular grains of rice or grape seeds) or other components of the tubular insert, as well as the subdivision of the tubular insert into tubular insert portions 32, also contribute to preventing the collapse of the tubular insert under the weight of the baby, and therefore promote comfort. Furthermore, the maintenance of the shape of said tubular insert guarantees the barrier function thereof.

Figure 9:
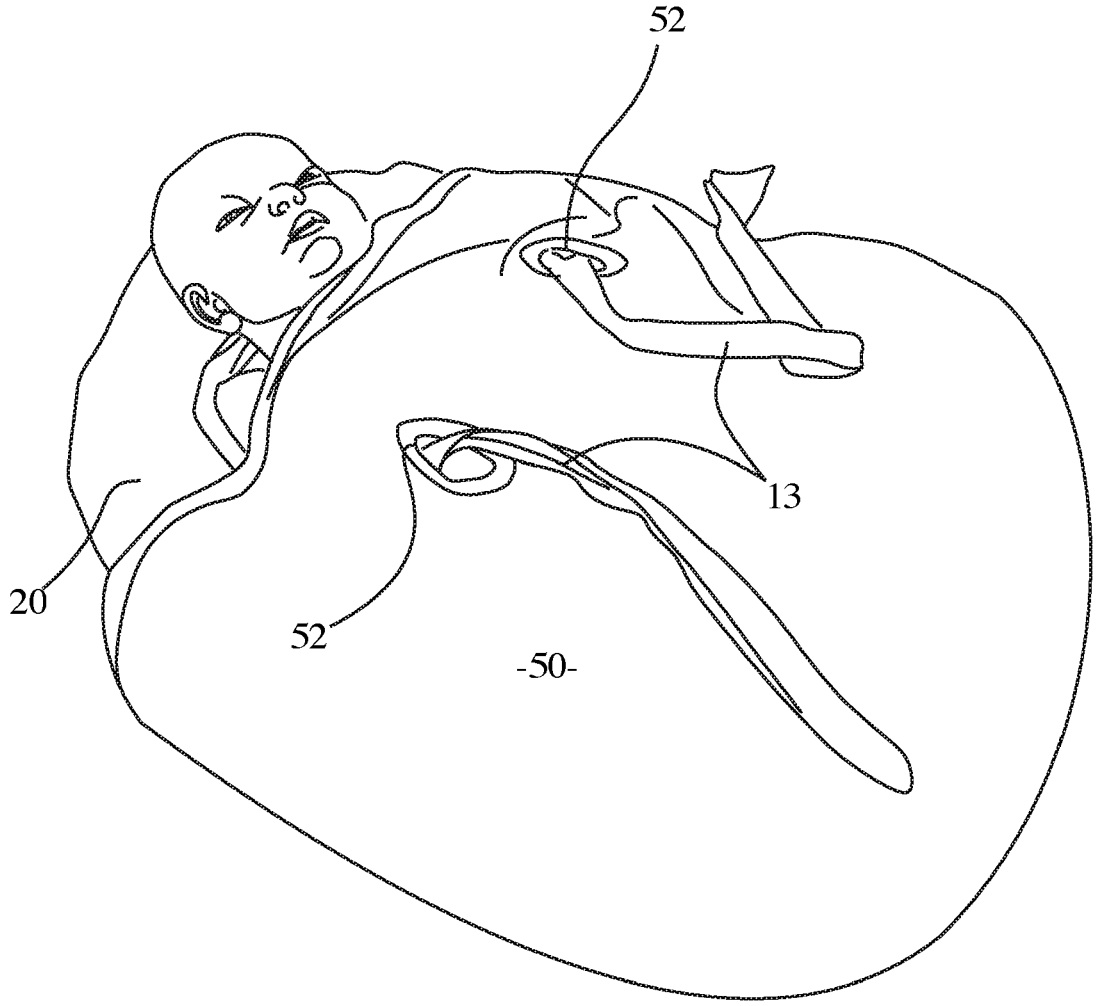
FIG. 9 is a schematic top view similar to FIG. 1 showing a final step of the placement of the baby.

The cover 50 is fastened at its upper end 51 for example by stitching to the bottom 11 of the base 10. This cover 50 is made from a soft and warm material, for example polar fleece, merino wool, alpaca, organic cotton, hemp, linen, etc. This cover has a substantially rectangular shape, it may also be oval or have another shape, the essential point being that it has dimensions and in particular a length both sufficient to cover the bottom 11 and to be able to be folded over the body of the baby, as shown in FIG. 9, for example. According to another example, the dimensions of the cover are provided so as not to cover the baby's face when it is folded over, for safety reasons.

The cover is configured thus to cover the free parts 25, 26 of the edge roll in contact with the body of the baby. These free parts that are thus well-insulated from the outside can emit heat accumulated during prior heating of the tubular insert for a longer time.

Depending on the case, it will be possible to provide that the cover is only fastened to the lower end or in another part of the base. It will also be possible to provide that the cover is fastened removably by buttons or snaps or the like.

This cover 50 also includes two openings 52 intended to cooperate with soft ties 13 fastened on each side of the bottom 11 by seams 13*a* and intended to allow the cover 50 to be held in place on the baby once the latter is positioned on the pillow, as will be seen later.

The swaddling cloth 40 has a very elongated and substantially rectangular shape, defining an approximately rectangular central part 41 that is intended to be fastened on the bottom 11 of the base by seams 41*a*, and two slightly triangular lateral parts 42, slender at their free ends 42*a* and extending on either side of the central part 41. This cloth 40 will also be able to be fastened on the base removably using snaps or buttons.

FIGS. 7, 8, 9 and 1 illustrate the first usage embodiment of the bedding article or pillow according to the invention.

Figure 7:
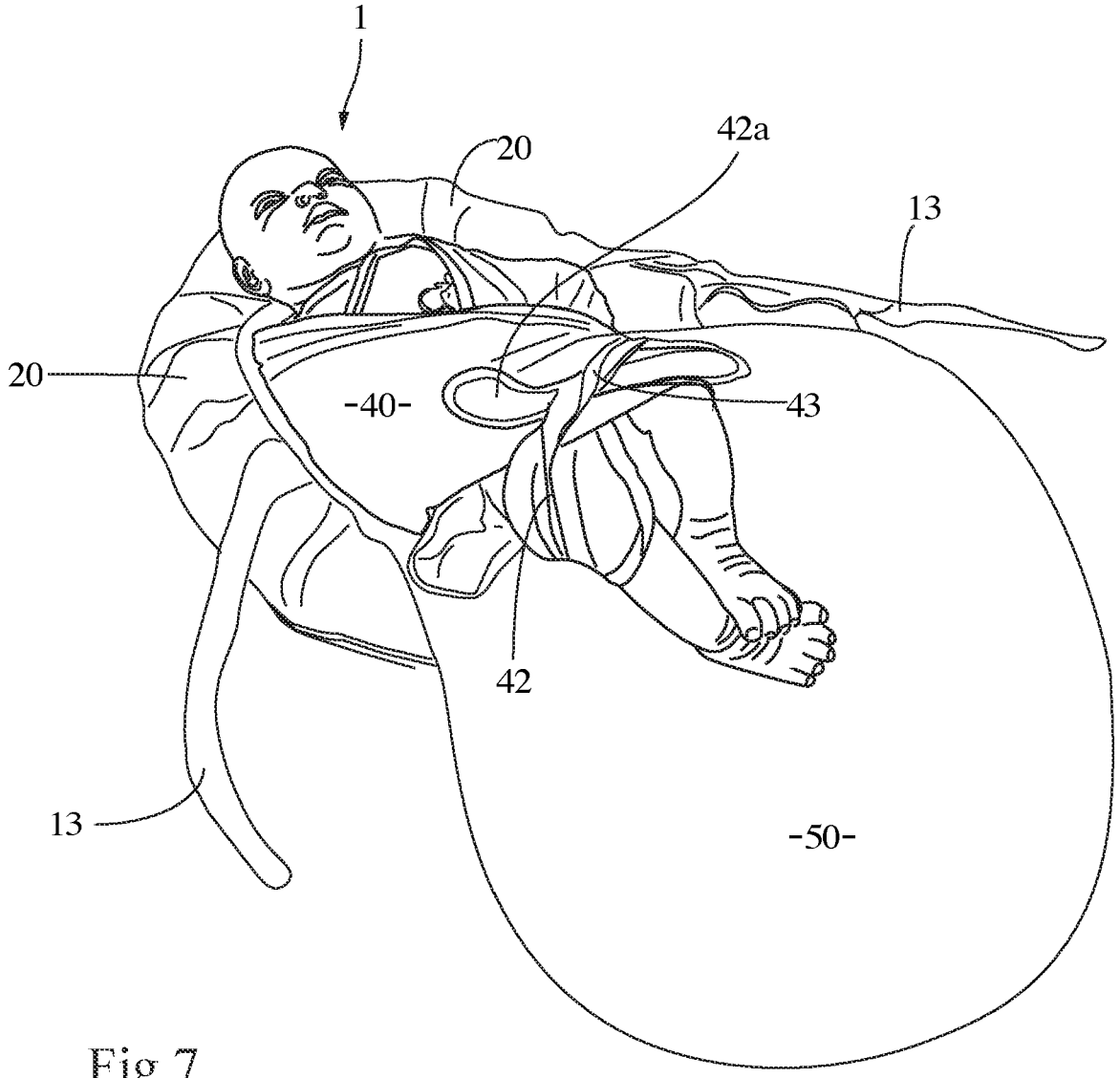
FIG. 7 is a perspective view showing the beginning of placement and swaddling of the baby.
Figure 8:
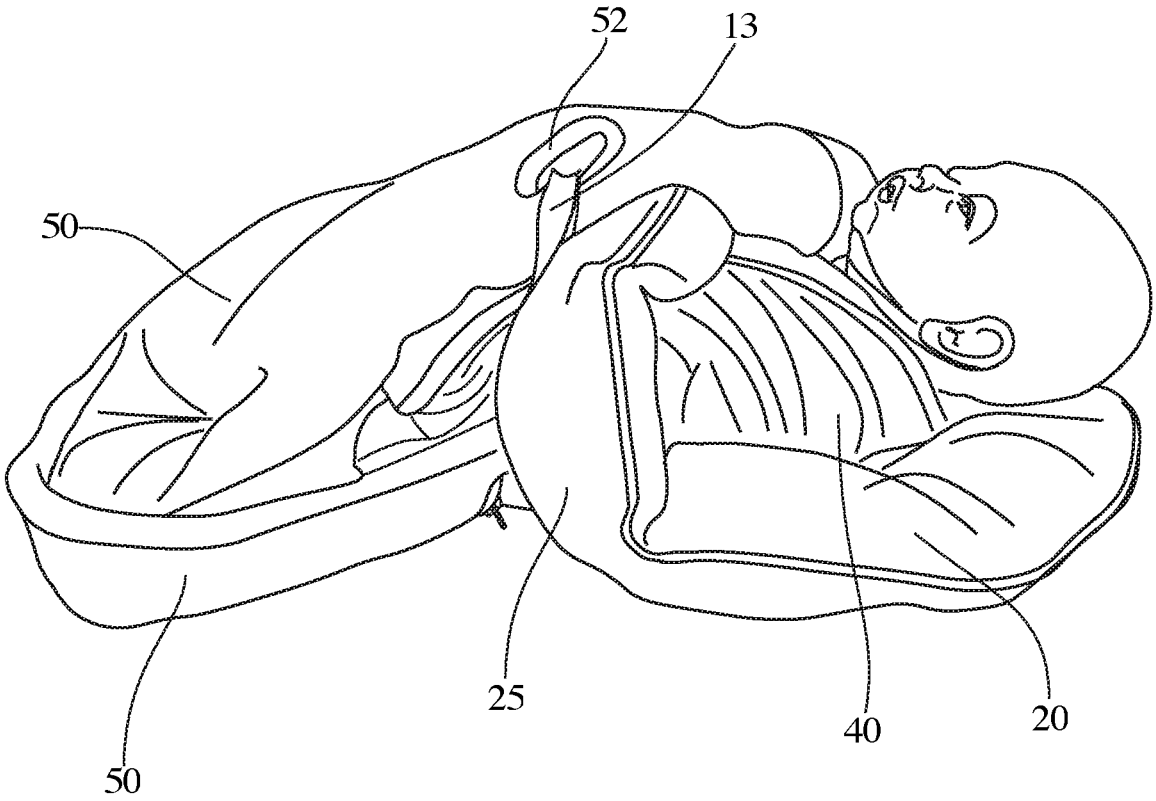
FIG. 8 is a side view of another step of the placement of the baby.

First, the tubular insert 30 is removed from the edge roll 20 through the opening 21. It is brought to the desired temperature, for example between 40 and 43° C., by placement in a microwave oven. It is next placed back inside the tubular insert 20 and the opening 21 thereof is closed. The baby is then positioned on the bedding article 1 such that his head rests on the upper end of the edge roll 20 and his feet on the lower end of said edge roll 20, as shown in FIGS. 7 and 8. Next, the baby is swaddled using the cloth 40. To that end, the ends 42 of the cloth are folded over the top of the baby's body, they are next passed below the legs, then passed back over and lastly tied in a knot 43 in order to ensure comfortable and safe swaddling of the baby.

The free end 25 of the edge roll is next folded over on the baby's stomach, as shown in FIG. 8, in order to guarantee good digestion by the baby. Lastly, the cover 50 is also folded over on the baby so as to keep the latter warm. As shown in FIG. 8, the ends of the ties 13 are inserted beforehand into the openings 52 of the cover and, once the latter is in place on the baby, they are tied in a knot 53, to arrive at the result shown in FIG. 1.

Ultimately, owing to the combination of the swaddling cloth 40 and the edge roll 20, the baby is kept in a fetal position with the head slightly raised and the legs together; he is kept very warm in this position owing to the heat diffused by the tubular insert 30 filled with heating grains and gradually emitting their heat, as well as by the cover 50, which stays correctly in place and does not risk slipping owing to the holding ties 13. Furthermore, the free end 25 of the edge roll exerts a slight, warm pressure on his stomach and therefore facilitates his digestion.

Lastly, the baby is kept safely on the pillow by the swaddling cloth. It will also be noted that the flat, low structure of the bottom 11 associated with the peripheral edge roll 20 avoids any risk of tipping of the baby, unlike the thick pillows previously described.

FIGS. 10 to 20 illustrate a second embodiment of a bedding article according to the invention.

Figure 10:
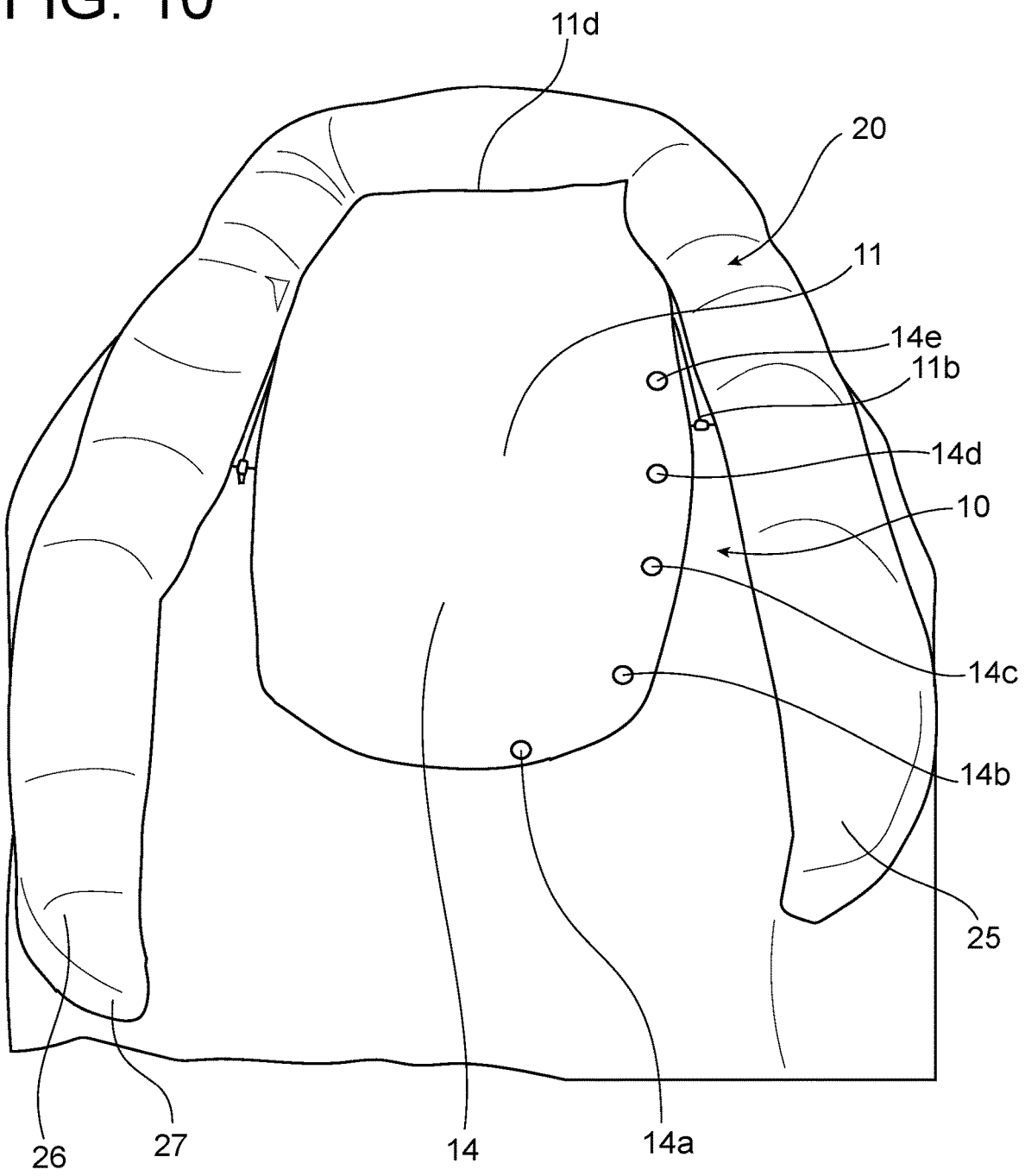
FIG. 10 is a schematic perspective view of another exemplary embodiment of the bedding article according to the invention.
Figure 11:
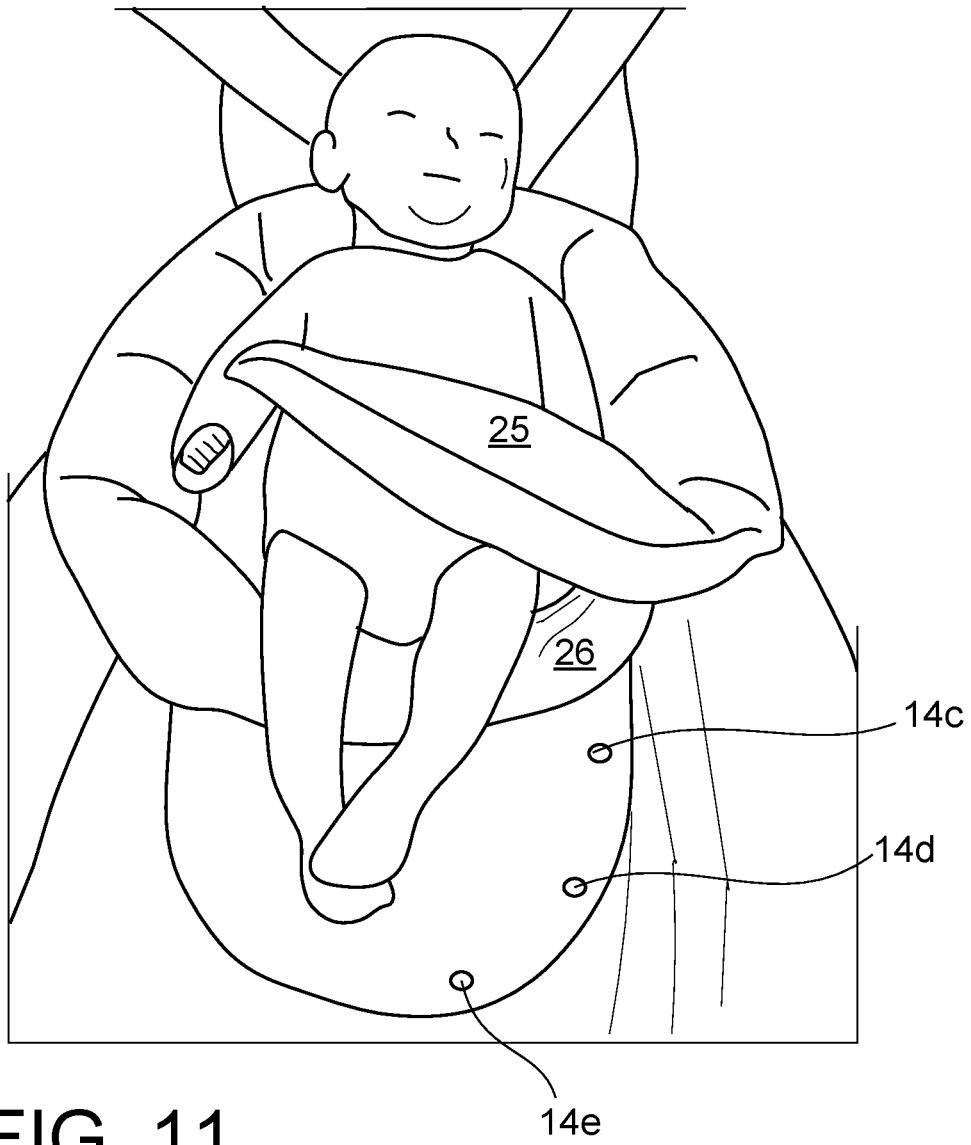
FIG. 11 is a schematic perspective view according to FIG. 10 with a baby in position.

In FIGS. 10 and 11, the article comprises a base 10 comprising a bottom 11 as well as an edge roll 20 that is fastened on the upper part 11*d* of the bottom and on the side parts 11*b* so as to release two free ends 25, 26. The second free end 26 can comprise a removable connection means as a quick fastener, such as a snap or the like. The connection means can be positioned on the side face of the base (as shown in dotted lines). The bottom 11 comprises, on one side, a series of connection means 14 complementary to the connection means 27. These connection means 14 can be formed by snaps 14*a*, 14*b*, 14*c*, 14*d*, 14*e* arranged along the bottom and distributed evenly or at varying distances. Thus, these connection means 27, 14 form a means for adjusting the folded position of the free end to raise the legs of the baby as shown in FIG. 11. The first free end 25 is in turn used like in the previous embodiment, namely to support the stomach of the baby.

Figure 12:
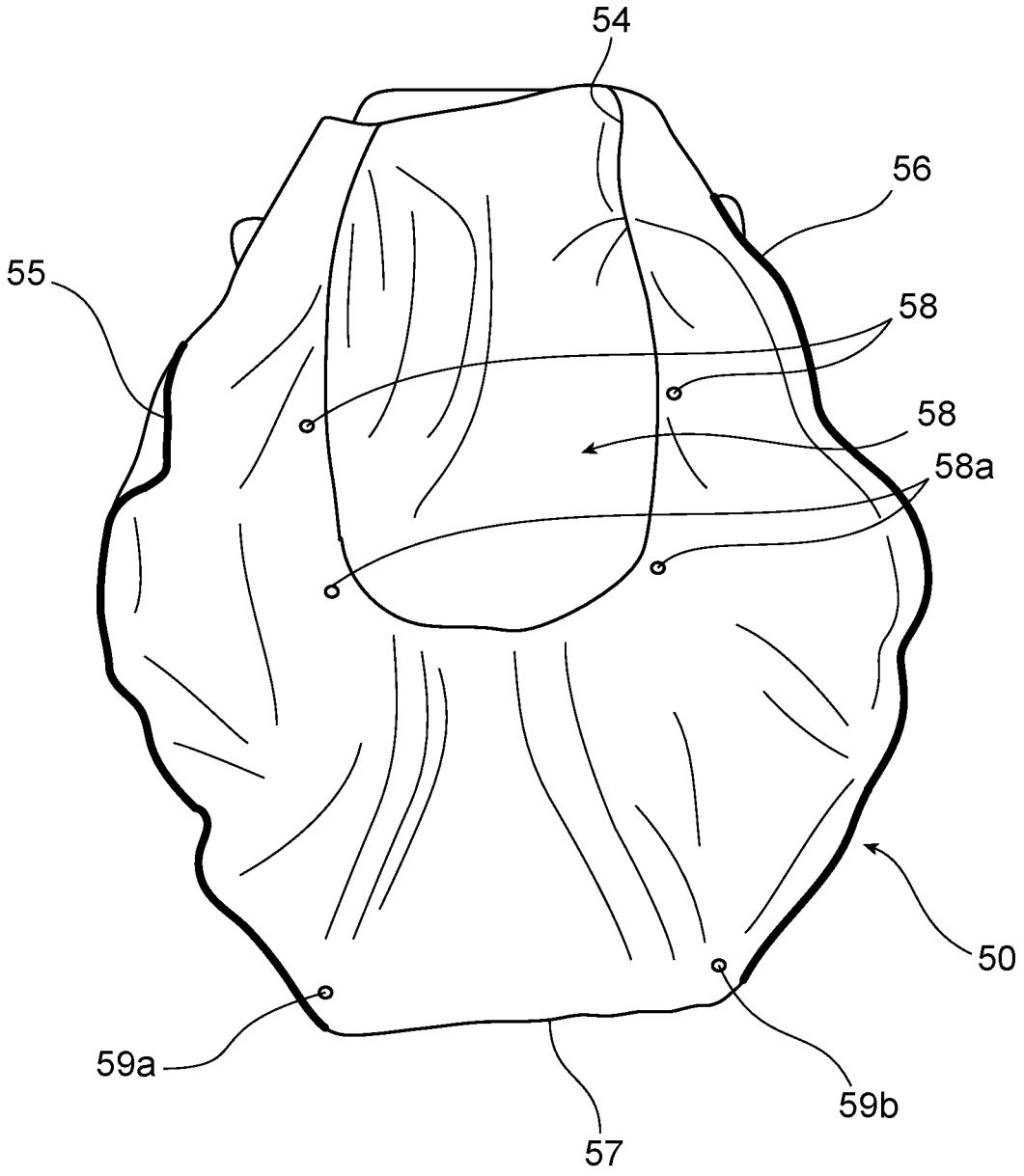
FIG. 12 is a back view of the bedding article of FIG. 10 with the cover at maximum volume.
Figure 13:
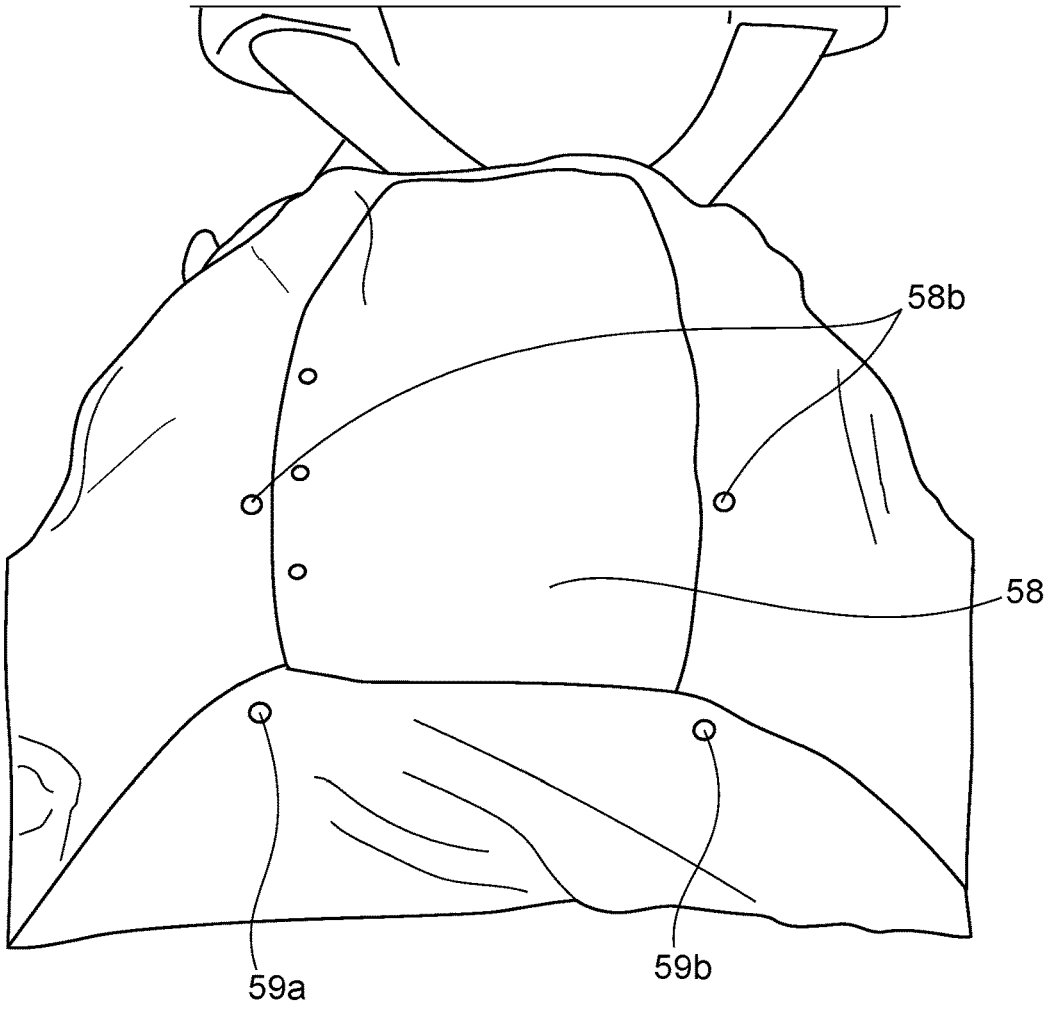
FIG. 13 is a back view of the bedding article of FIG. 10 with the cover partially turned over and removably fastened to reduce the volume.
Figure 14:
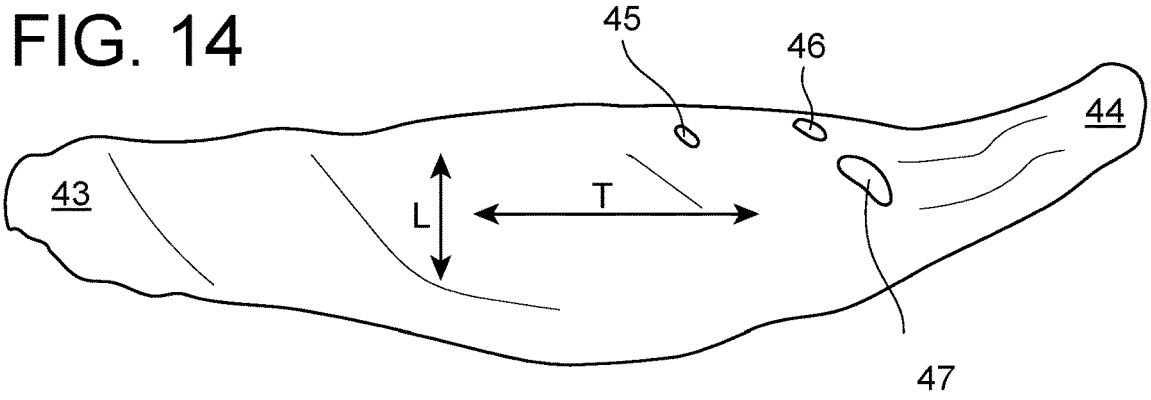
FIG. 14 is a partial view of the swaddling cloth according to a variant embodiment.
Figure 20:
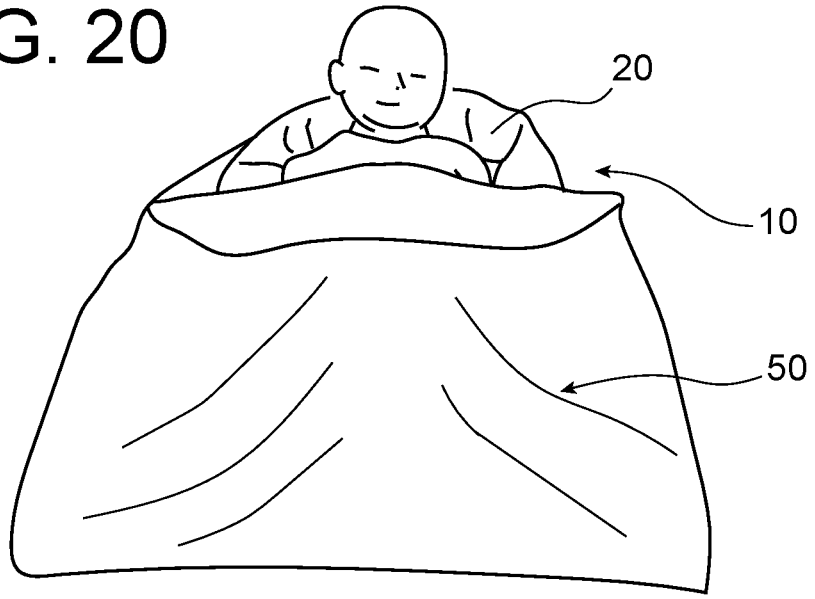
FIG. 20 is a front view of the bedding article of FIG. 10 with the cover at maximum volume in the covering position.

According to one possible aspect illustrated in FIGS. 12 and 13, the bedding article can comprise a cover 50 connected to the bottom 11 and forming part of the soft base 10. The cover thus comprises a rear layer on which the bottom 11 is connected and a front layer covering at least part of the edge roll (FIG. 20). In this example, the cover is configured like a bag of the "baby sleeping bag" type. The cover can be sewn for example by a seam 54 at the bottom 11 of the base and on its face opposite the face receiving the baby or comprising the edge roll. The cover can comprise a zipper portion 55, 56 in order to facilitate the covering of the baby.

The bag forming the cover can have an adjustable volume. Thus, the cover comprises a foldable lower edge 57 and that can be fastened by removable connection means, for example quick fasteners on a median part 58 of the cover. In particular, the cover can comprise first fastening means 59*a*, 59*b* arranged on or near said lower edge 57 cooperating with at least one pair of complementary fastening means 58*a*, preferably several pairs 58*a*, 58*b* arranged on the bottom of said cover. When several pairs are provided, they are arranged at varying distances from the lower edge 57 in order to allow an adjustment of the bag according to different possible volumes. FIG. 13 illustrates an exemplary restriction of the volume of the bag of the cover by engaging means of the edge 59*a*, 59*b* with the first pair of connection means 58*a*. Thus, the volume can be adapted to the size of the baby in order to reduce heat losses.

FIGS. 14 to 18 show a swaddling cloth 40 that may be part of the bedding article. The swaddling cloth 40 may have an elongated shape in the direction of the ends in a transverse direction T. Additionally, the cloth may have a width (or length in the longitudinal direction L) that becomes smaller in the direction of the transverse ends of the cloth 43, 44 so as to facilitate the folding and the formation of knots. The cloth may comprise at least two arm holes 45, 46 that are distant and substantially aligned in the transverse direction T. The distance between the holes is on the order of about 10 to 20 cm. Lastly, a passage 47 is provided that is distant from the holes in a longitudinal direction L. Preferably, this passage 47 is distant from the second hole 46 by a distance on the order of about 5 to 10 cm. This passage is thus configured to form a loop for one of the ends 43, 44 of said cloth.

Figure 15:
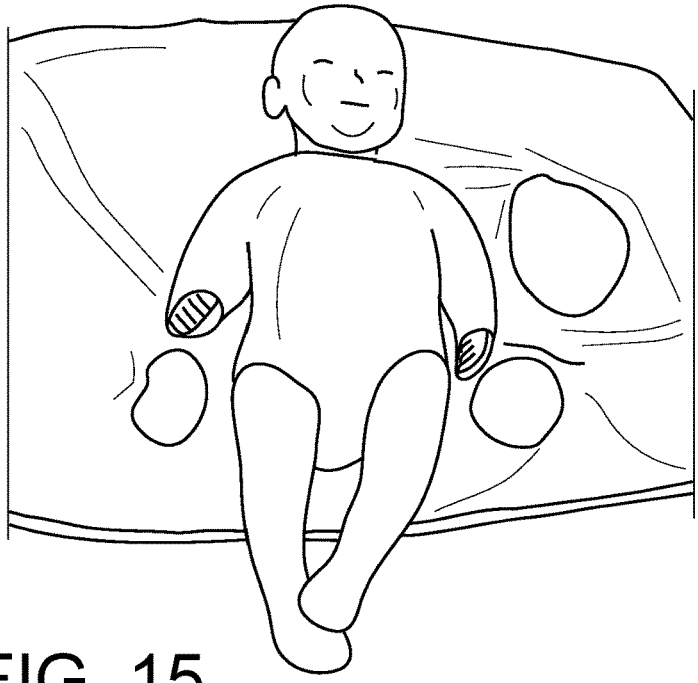
Figure 16:
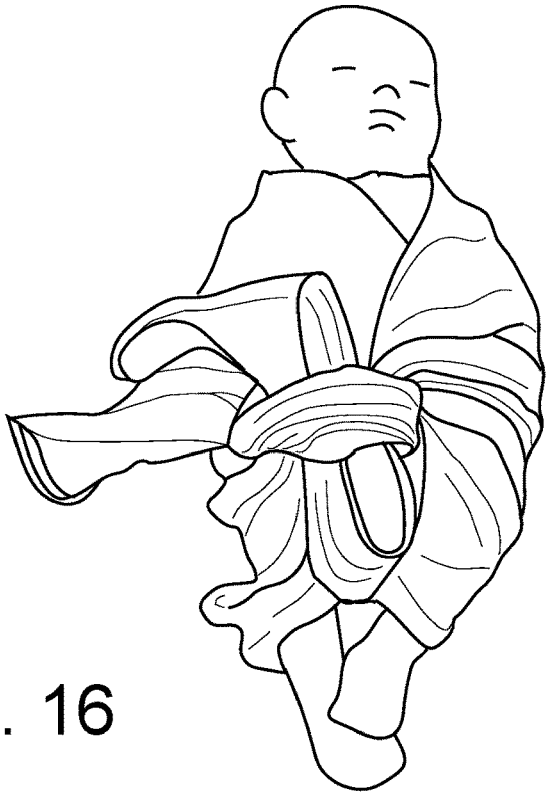
FIG. 16 is a schematic view of the baby swaddled by the cloth of FIG. 14 according the position of FIG. 15.
Figure 17:
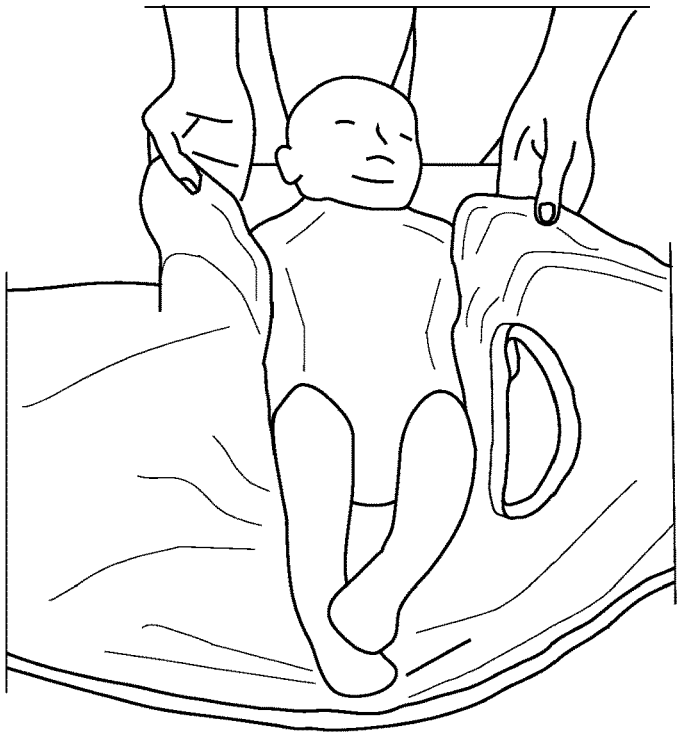
FIG. 17 is a schematic view of the position of the baby on the swaddling cloth for swaddling with arms out.
Figure 18:
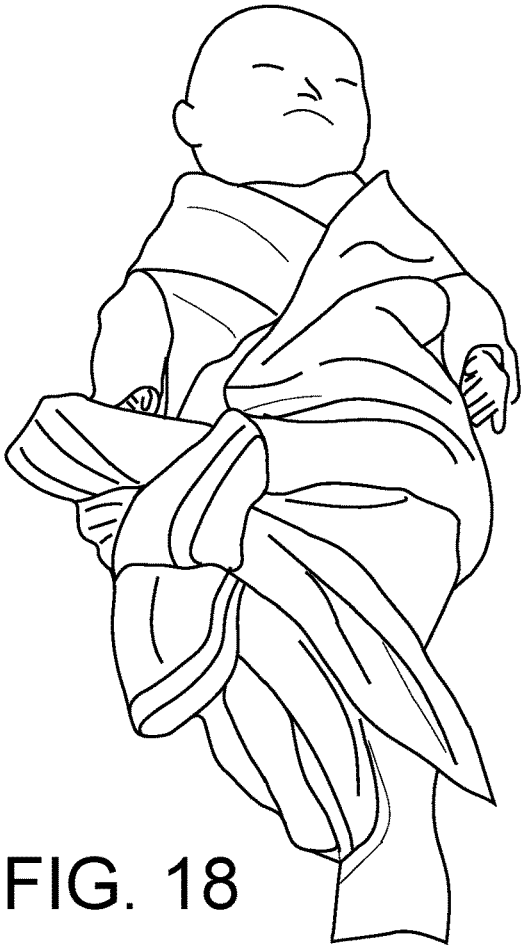
FIG. 18 is a schematic view of the baby swaddled by the cloth of FIG. 14 according the position of FIG. 17.

The swaddling cloth thus produced has the interest of being able to assume two possible swaddling configurations: one, shown in FIGS. 15 and 16 for swaddling the baby's arms; the other, shown in FIGS. 17 and 18 for the free passage of the arms. Thus, in the configuration of FIG. 15, the cloth is positioned relative to the baby so that the passage of the loop is above the arm passage holes and the passage arms are located below the hands of the baby. In this way, it is possible to perform swaddling while keeping the arms captive in the cloth, as shown in FIG. 16. In the second configuration (FIG. 17), the cloth is turned over with the passage holes for the arms 45, 46 level with the arms of the baby. In this case, the swaddling makes it possible to have the arms come out of the cloth.

The baby thus swaddled can be positioned on the base like in FIG. 11, then the cover can be folded over the body of the baby and its volume potentially adjusted like in FIG. 13.

Figure 19:
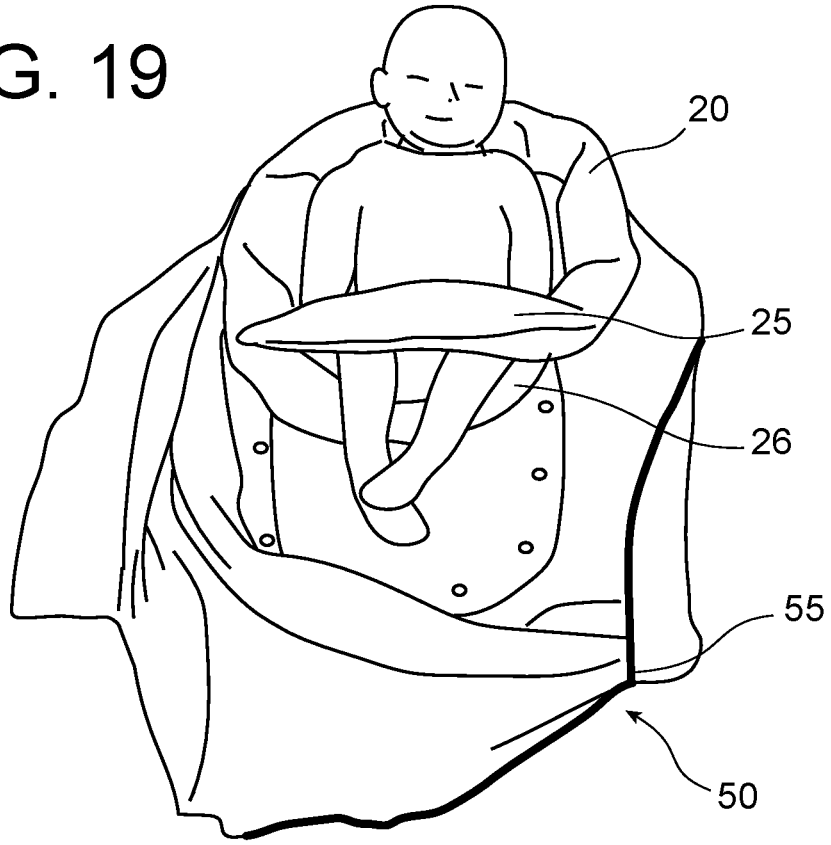
FIG. 19 is a front view of the bedding article of FIG. 10 with the cover at maximum volume in the open position.

FIG. 19 shows the bedding article when the cover is in the open position; the removable connection means (zipper 55) being separated. This position can be adopted if the ambient temperature is high, in particular in the summer, if the room in which the baby is located is too hot and/or if the baby's health condition requires it. The removable cloth 43 can be added if needed.

FIG. 20 shows the bedding article when the cover is in the protection or covering position; the removable connection means (zipper 55) being secured. The cover forms a pouch or bag only leaving the head visible, or part of the torso if the upper cover edge is folded over. The front portion or layer of the cover covers at least the free ends 25, 26 of the edge roll such that heat losses are reduced and the heat provided by these ends in contact with the baby is emitted for longer.

Ultimately, a bedding article is obtained that is very easy to use, changeable and meets all of the needs of a baby who has trouble sleeping:

need for safety, need for warmth, need to be kept in a determined position that extends both to finding the fetal position in the mother's body, and ease of digestion, need for a certain weight on the stomach that both influences digestion and makes it possible to maintain deep sleep for a certain length of time.

Furthermore, this bedding article is safe, since the baby is kept firmly in the desired position owing to the swaddling cloth fastened on the base, the cover is kept securely in place, owing to the tied fasteners, and it does not risk being removed during sleep even if the sleep is fussy and/or rising up over the baby's face, which increases both comfort and safety, and additionally the bedding article does not risk tipping, given the weight of the tubular insert, the swaddling of the baby and the low position of the latter.

Of course, the present invention is not limited solely to the embodiment described above as a non-limiting example, but encompasses all similar or equivalent embodiments.

Thus, the materials may be different, slightly different shapes could optionally be considered for the tubular insert and the base, for example the tubular insert could have a cross-section that is not circular, but elliptical or rectangular.

The cover 50 could also be removably fastened to the bottom and for example only be fastened by ties. Likewise, the cloth could also be fastened removably.

Furthermore, the assembly is flexible and light, and can be transported and be repositioned, placed in a stroller easily.

The removability of the tubular insert makes it possible to change and/or wash the assembly easily without destroying it.

The invention claimed is:

1. A bedding article for a baby comprising a soft base, with dimensions substantially corresponding to the dimensions of the baby to be received, this base comprising a bottom and an edge roll secured to the bottom and extending over at least part of the periphery of the base, the edge roll being provided with at least one free end able to be folded over a stomach of the baby, said bedding article including a cover connected to at least one end of the base covering at least one said free end of the edge roll, the edge roll contains a tubular heating insert configured to be heated so as to accumulate heat and to next emit it gradually, wherein the heating insert is at least partially disposed within the at least one free end, wherein the heating insert in the at least one free end exerts a weight on the stomach of the baby to improve digestion of the baby characterized in that it includes a cloth for swaddling the baby in the central position or independent from the soft base, the swaddling cloth has an elongated shape and the width of which becomes smaller toward the ends in a transverse direction; said cloth comprising two distant arm passage holes substantially aligned in the transverse direction and a passage distant from the holes in a longitudinal direction and configured to form a loop for one of the ends of said cloth.

2. The bedding article according to claim 1, characterized in that the cover comprises a foldable lower edge and first fastening means arranged on or near said edge cooperating with a series of complementary fastening means arranged on a bottom of said cover on the side opposite the soft base and at different distances from said edge so as to allow an adjustment of the volume of the cover.

3. The bedding article according to claim 1, characterized in that the heating insert is removable.

4. The bedding article according to claim 1, characterized in that the cover includes two openings able to cooperate with soft ties coming from the base.

5. The bedding article according to claim 1, characterized in that the tubular insert has a shape complementary to the edge roll and is contained in an enclosure of the tubular insert.

6. The bedding article according to claim 1, characterized in that the tubular insert is subdivided into tubular insert portions.

7. The bedding article according claim 1, characterized in that the tubular insert is a dry heating pad or a hot water bottle.

8. The bedding article according to claim 1, characterized in that the heating insert contains heating elements configured to store heat and gradually emit this heat;

these elements being organic, and comprising one or more of grains of linen, grains of rice, barley, wheat, lentils, grape seeds, peas, lupine seeds, chickpeas, fruit cores, dried plants, sugarcane, other dried vegetables, other cereal grains, or being inorganic and comprising one or more of beads or small pieces of clay, silicone, plastic, ceramic, glass, sand and combinations thereof.

9. The bedding article according to claim 1, characterized in that the edge roll is provided over its entire length with a closable opening.

10. The bedding article according to claim 1, characterized in that the cover is positioned at one end of the base or forms a bag connected to the base.

11. The bedding article according to claim 1, characterized in that the edge roll comprises a second free end that is dimensioned to be able to be folded over on the base to serve as a booster for legs of the baby.

12. The bedding article according to claim 11, characterized in that the cover is configured to completely cover the second free end in the folded over position.

13. The bedding article according to claim 12, characterized in that the cover comprises at least one front covering layer connected to the base that can be folded over the free ends.

14. The bedding article according to claim 11, characterized in that the heating insert extends in the second free end.

15. The bedding article according to claim 11, characterized in that the second free end comprises a detachable fastening means for fastening it on the bottom removably in the folded over position on the base.

16. The bedding article according to claim 11, characterized in that the cover is configured to receive said second free end of the edge roll in the folded over position of said second free end.

17. The bedding article according to claim 11, characterized in that the second free end comprises at least a first removable connection means and the flexible base comprises a series of second removable connection means that are complementary to the first means; the second means being distributed on one side of the bottom of the flexible base and at a distance from one another so as to make it possible to adjust the height of the fastener of the free end on the soft base as a function of a size of the baby.

18. The bedding article according to claim 11, characterized in that the edge roll is fastened on an upper part and on side parts of the bottom so as to release the free ends.

19. The bedding article according to claim 11, characterized in that the second free end comprises a detachable fastening means complementary to at least one connection means of the bottom in order to fasten the second free end under legs of the baby to be used to raise the legs of the baby.

20. A bedding article for a baby comprising a soft base, with dimensions substantially corresponding to the dimensions of the baby to be received, this base comprising a bottom and an edge roll secured to the bottom and extending over at least part of the periphery of the base, the edge roll being provided with at least one free end able to be folded over a stomach of the baby, said bedding article including a cover connected to at least one end of the base covering at least said free end of the edge roll, the edge roll contains a tubular heating insert configured to be heated so as to accumulate heat and to next emit it gradually, wherein the heating insert is at least partially disposed within the at least one free end, wherein the heating insert exerts a weight on the stomach of the baby to improve digestion of the baby.

* * * * *